United States Patent [19]

Knopp

[11] 4,023,294

[45] May 17, 1977

[54] SAFETY DEVICE FOR FIREARMS

[76] Inventor: Joseph P. Knopp, 901 Robert Road, Lincoln, Nebr. 68510

[22] Filed: July 19, 1976

[21] Appl. No.: 706,391

[52] U.S. Cl. ..... 42/1 LP
[51] Int. Cl.[2] ..... F41C 27/00
[58] Field of Search ..... 42/1 LP, 1 N

[56] References Cited

UNITED STATES PATENTS

| | | | |
|---|---|---|---|
| 2,478,098 | 8/1949 | Hansen | 42/1 LP |
| 2,836,918 | 6/1958 | Pula et al. | 42/1 LP |
| 2,887,807 | 5/1959 | Santangelo | 42/1 LP |
| 3,154,874 | 11/1964 | Stewart | 42/1 LP |
| 3,360,880 | 1/1968 | Finnegan | 42/1 LP |

*Primary Examiner*—Charles T. Jordan
*Attorney, Agent, or Firm*—Lowe, Kokjer, Kircher, Wharton & Bowman

[57] ABSTRACT

For insertion in a firearm to prevent discharge thereof, a plastic rod having longitudinal ribs fits in the barrel and extends into one of the cylinder chambers of the weapon. The outer end of the rod is recessed from the muzzle end of the barrel and is tapped and threaded. A key threads into the rod and may be pulled outwardly to remove the rod from the gun barrel.

10 Claims, 4 Drawing Figures

SAFETY DEVICE FOR FIREARMS

BACKGROUND AND SUMMARY OF THE INVENTION

This invention relates to a safety device which is used to secure a firearm against being fired.

There have been various types of safety plugs and the like developed for insertion in a gun barrel to prevent firing of the gun. Typical examples of such safety devices are found in the Hansen U.S. Pat. No. 2,478,098, the Garretson U.S. Pat. No. 2,479,107, and the Santangelo U.S. Pat. No. 2,887,807. Each of these devices provides a rod or plug which is installed in a gun barrel to lock the gun against discharge.

These safety devices and others of this genre require complex lock mechanisms in order to secure the safety plug in the gun barrel. Consequently, costs are rather high and the time and effort involved in inserting and removing the plug are considerable. Moreover, the rods are typically smaller in size than the bore of the gun barrel so that they are susceptible to falling out of the barrel in the event of a failure of the lock or inadvertence of the user to secure the lock.

The locks used with typical safety plugs universally project beyond the muzzle end of the gun barrel. Such is a significant drawback from at least two standpoints. First, the projecting parts of the safety device destroy the esthetic appearance of the firearm for purposes of display. Many gun owners do not employ safety mechanisms for this reason. Secondly, a lock which projects from the gun barrel is readily accessible for tampering should the weapon come into the possession of an unauthorized person.

An additional difficulty with existing safety devices is they are often suitable only for a single caliber of firearm and their versatility is thus lacking. A further problem is that some existing devices simply plug the barrel rather than the firing chamber, and the gun is not actually secured against being inadvertently fired since it is still possible to place a shell in the firing chamber. Many devices, on the other hand, require that the plug be secured at the breech end of the gun after having been inserted from the muzzle end. Accordingly, the operations required to secure the device in place and to remove it tend to be excessively complicated and, again, there arises a situation where the safety device is simply not used.

It is an important object of the present invention to provide a firearm safety device which is improved in its construction and simplified in its use as compared to existing safety mechanisms. At the same time of achieving the advantages of simplicity in construction and use, the safety device does not distract from the esthetic appearance of the firearm and, consequently, the device may be readily used for guns on display.

Another object of the invention is to provide a safety device which includes only two parts and which does not require a complicated locking mechinism such as those typically employed in prior art devices.

Still another object of the invention is to provide a safety device which is adapted to be used with firearms of various types and sizes and to fit tightly within the gun barrel and firing chamber in order to be difficult to remove.

A further object of the invention is to provide a safety device of the character described which is recessed within the barrel so as to be inaccessible other than with a special tool.

An additional object of the invention is to provide a safety device of the character described which is inserted into the barrel and removed therefrom entirely from the muzzle end. Thus, the device achieves universal application for breech and muzzle loading weapons.

Other and further objects of the invention, together with the features of novelty appurtenant thereto, will appear in the course of the following description.

DETAILED DESCRIPTION OF THE INVENTION

In the accompanying drawings, which form a part of the specification and are to be read in conjunction therewith, and in which like reference numerals are employed to indicate like parts in the various views.

Figure 1:
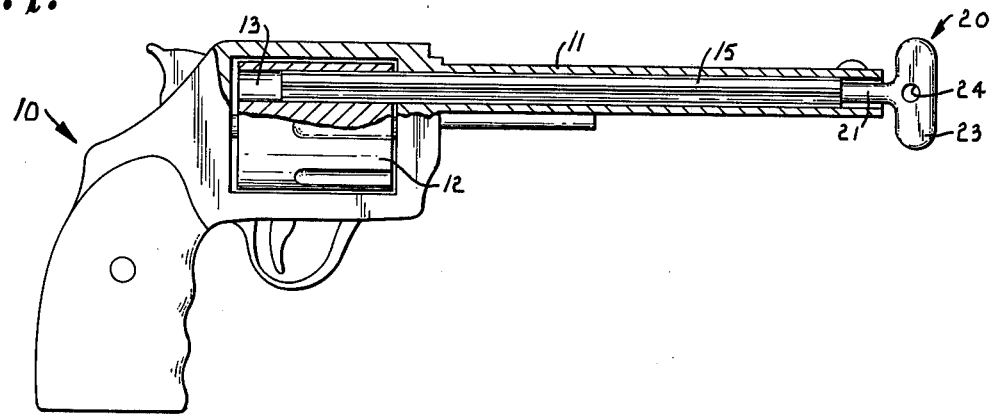
FIG. 1 is a side elevational view illustrating the safety device of the present invention installed in the barrel of a typical handgun, with the barrel and part of the cylinder shown in cross section.

Referring to the drawings in more detail, FIG. 1 illustrates a typical hand gun 10 with which the safety device of the present invention may be used. The hand gun 10 is of the revolver type, having a barrel 11 and a cylinder 12 comprising a plurality of shell chambers which may be successively and rotatively aligned with the inner end of barrel 11 to provide a firing chamber 13 therefor. The hand gun 10 is illustrative only, and it is to be understood that the invention is equally useful as a safety device for other types of firearms such as those in which the firing chamber forms an integral part of the gun barrel itself.

Figure 2:
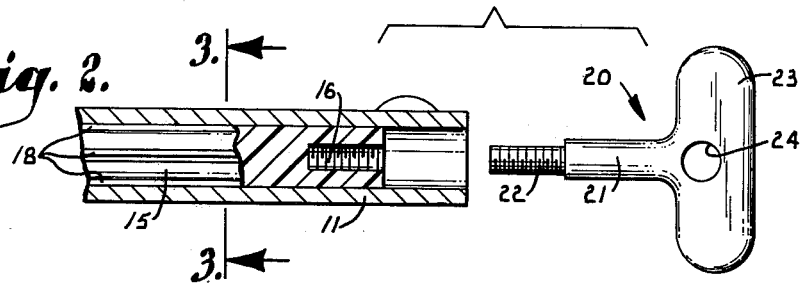
FIG. 2 is an enlarged fragmentary view in cross section showing the end of the gun barrel with the rod inserted therein and the key member removed from the rod.
Figure 3:
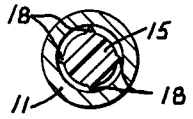
FIG. 3 is a sectional view taken generally along line 3—3 of FIG. 2 in the direction of the arrows.
Figure 4:
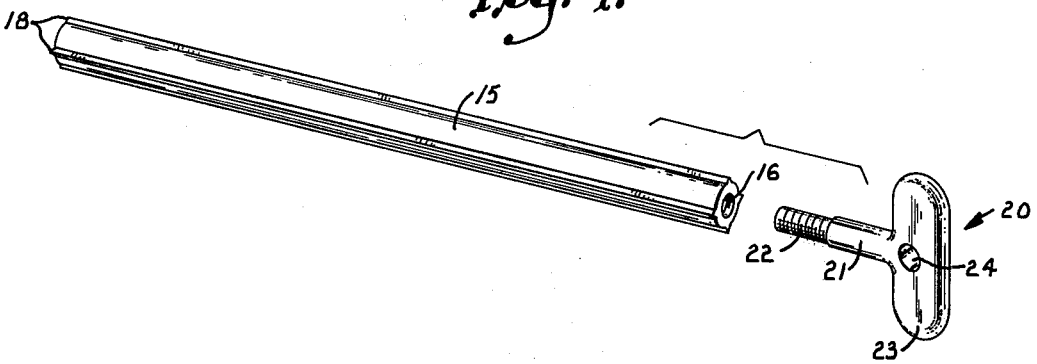
FIG. 4 is a perspective exploded view of the safety device.

The safety device includes an elongate rod 15 which is preferably constructed of plastic or a similar substance. The rod is generally cylindrical and is slightly smaller in diameter than the bore of barrel 11, as best shown in FIG. 3. Referring again to FIG. 1, the length of the rod is such that it is able to extend almost the entire length of barrel 11 and into the aligned firing chamber 13, but is shorter in length than the combined length of the barrel plus firing chamber 13. Rod 15 may extend entirely through chamber 13 or only partially therethrough as shown in FIG. 1, but in any event the outward end of the rod is recessed from the muzzle end of barrel 11 when the rod is fully inserted therein. The outer end of rod 15 is tapped and internally threaded as indicated at 16 in FIG. 2.

Four ribs 18 are formed integrally on the exterior surface of rod 15 to extend longitudinally the entire length of the rod to grip the rifling or interior wall of the gun barrel 11. Ribs 18 are spaced substantially 90° from one another around the rod and, as shown in FIG. 3, each rib gradually tapers to an edge as it projects outwardly from rod 15. The ribs are resilient members which may be deformed in order that rod 15 may be inserted in barrels having various bore sizes, as will be explained more fully.

A key member 20 is used to remove rod 15 from the gun barrel. The key 20 includes a cylindrical shank 21 which is reduced in diameter and externally threaded on its end portion 22 to mate with the threaded area 16 of the rod. An enlarged handle 23 is located at the end of the shank opposite the threaded end 22. An opening 24 is formed through handle 23. Shank 21 is considerably smaller in diameter than barrel 11 so as to be easily insertable therein.

In use, the safety device is installed in the gun barrel to prevent the gun from being discharged. Rod 15 is inserted in barrel 11 from the muzzle end thereof, preferably with key 20 attached to the rod. When the rod has been pushed fully into the barrel approximately to the position shown in FIG. 1, its inner end is extended well into one of the firing chambers 13 and its outer end is recessed somewhat inwardly of the muzzle end of the barrel. Rod 15 therefore prevents cylinder 12 from revolving and precludes firing of the gun 10. If there is a shell in the chamber 13 that is aligned with barrel 11, rod 15 will not fit entirely within the barrel and the presence of the shell is thus easily detected so that it can be removed.

When rod 15 has been fully inserted in the barrel to the position of FIG. 1, key 20 is removed by turning it in a manner to unthread its end portion 22 from the rod. The ribs 18 tightly engage the internal walls of barrel 11 to establish a friction fit that holds the rod firmly in place in the barrel. As previously indicated, ribs 18 are deformable in a resilient manner so as to accommodate different sized barrels while providing a firm friction fit with each barrel in which rod 15 is inserted. Since the outer end of rod 15 is recessed well inwardly of the muzzle end of the barrel, the rod is inaccessible and cannot be removed without using the key 20.

With the rod 15 inserted in the barrel as described, the fire chamber of the weapon is thus partially filled and one is precluded from accidentally placing a shell in the firing chamber without first removing the safety device. It should be noted that when the rod 15 is inserted and the key 20 removed therefrom, the rod 15 is entirely contained within the gun barrel and the weapon may be safely displayed without impairing its esthetic appearance.

To withdraw rod 15, key 20 is inserted in the muzzle end of the barrel and turned to thread its end portion 22 into the threaded area 16 at the end of the rod. After the threaded connection is made, the key may be pulled to remove the rod 15 from the barrel.

Thus it is apparent than an improved and esthetically pleasing safety device is provided which may be used with firearms of various types and sizes. While the device is particularly effective for the revolver-type hand gun 10, it is also useful with other types of hand guns and even with rifles if rod 15 is made long enough. The rod is inserted and removed entirely from the muzzle end so that operations need not be performed from the opposite or cylinder end of the barrel. The longitudinal ribs 18 allow a single rod 15 to be employed with barrels of different bore diameter, thereby increasing the versatility of the device.

From the foregoing it will be seen that this invention is one well adapted to attain all ends and objects hereinabove set forth, together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A safety device for a firearm having a hollow barrel with a muzzle end and a firing chamber located at the opposite end of the barrel, said device comprising in combination:

an elongate rod adapted to be inserted from said muzzle end into said barrel and firing chamber to grippingly engage the interior wall of said barrel, said rod being shorter in length that the combined length of said barrel and firing chamber;

a tool for inserting and removing said rod from the barrel and firing chamber, said tool including a shank portion smaller in size than said barrel and of sufficient length to push said rod into said firing chamber when said shank portion is inserted into said barrel from the muzzle end; and means for coupling said shank portion of the tool with said one end of the rod within said barrel, whereby said tool may be pulled outwardly of the muzzle end of said barrel remove said rod therefrom.

2. The invention of claim 1, wherein said rod is of smaller diameter than said barrel and includes spaced apart ribs extending generally longitudinally along the exterior surface of said rod, said ribs grippingly engaging the interior wall of said barrel to retain said rod therein.

3. The invention of claim 2, wherein said ribs are resiliently deformable to permit said rod to be received in barrels having different bore sizes.

4. The invention of claim 2, wherein each rib is tapered outwardly from said rod.

5. The invention of claim 1, wherein said coupling means comprises a threaded connection of said tool with said one rod end.

6. The invention of claim 1, including an enlarged handle on said tool connected with said shank portion at one end thereof.

7. The invention of claim 1, wherein said one end of the rod is tapped and threaded and said shank portion of said tool has an end which is matingly threaded to provide said coupling means.

8. The invention of claim 7, including an enlarged handle of said tool connected with said shank portion at the end thereof opposite the end which is threaded.

9. The invention of claim 7, wherein said rod is of smaller diameter than said barrel and includes a plurality of spaced apart ribs extending generally longitudinally along the exterior surface of said rod, said ribs grippingly engaging the internal walls of said barrel to retain said rod therein.

10. The invention of claim 9, wherein each rib is tapered outwardly from said rod.

* * * * *